US006293816B1

(12) United States Patent
Scheitz et al.

(10) Patent No.: US 6,293,816 B1
(45) Date of Patent: Sep. 25, 2001

(54) HIGH ARC RESISTANT CONNECTOR HAVING A FLEXIBLE WIRE-TRAP MEMBER

(75) Inventors: John T. Scheitz, Barrington; Kenneth P. Lemke, Cary, both of IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 09/828,043

(22) Filed: Apr. 9, 2001

(51) Int. Cl.[7] ..... H01R 4/24

(52) U.S. Cl. ..... 439/441; 439/439

(58) Field of Search ..... 439/436, 437, 439/438, 439, 440, 441, 828, 834, 835

(56) References Cited

U.S. PATENT DOCUMENTS 5,174,784 * 12/1992 Penning ..... 439/441
5,292,260 * 3/1994 Sinisi et al. ..... 439/441
5,494,456 * 2/1996 Kozel et al. ..... 439/441

* cited by examiner

*Primary Examiner*—Tho D. Ta
(74) *Attorney, Agent, or Firm*—Karl D. Kovach

(57) ABSTRACT

A wire-trap member that has a member which can apply a force to restrict the movement of a wire conductor therein and/or a number of contact tails positioned along the width of the connector is provided. The applied force generates a torsional force within the contact and the contact is more flexible. The connector of the present invention can utilize the wire-trap member, the contact tails and combinations thereof to secure the wire conductor within the connector and prevent arcing as the size of the connector is reduced.

17 Claims, 4 Drawing Sheets

Fig. 2
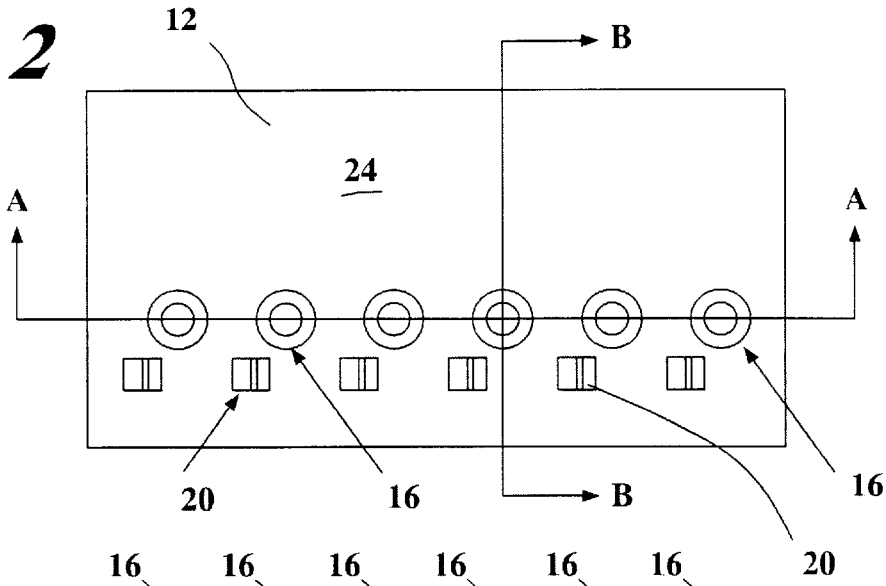
Fig. 3
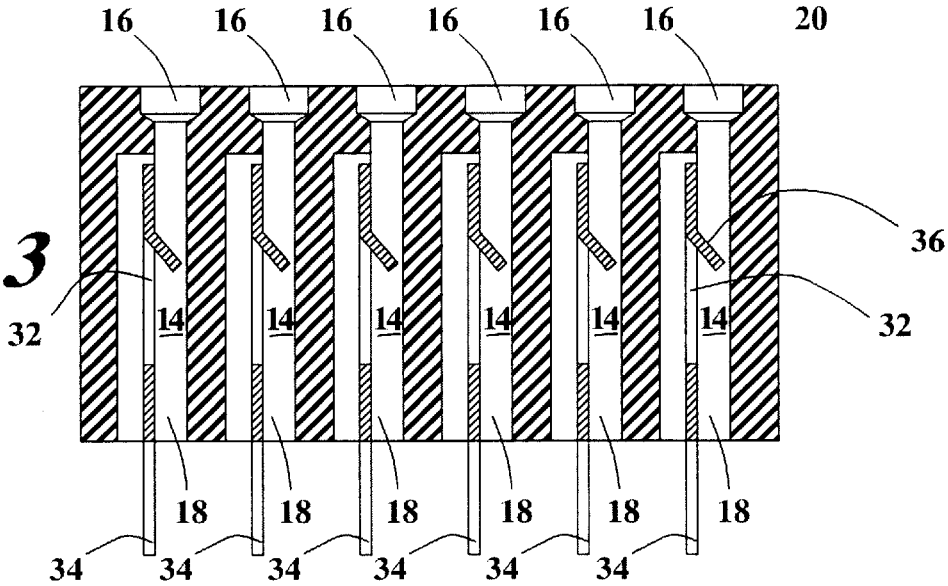
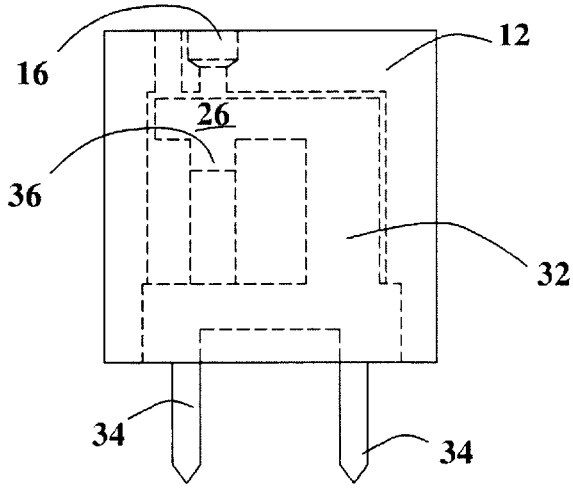
Fig. 4

Fig. 5
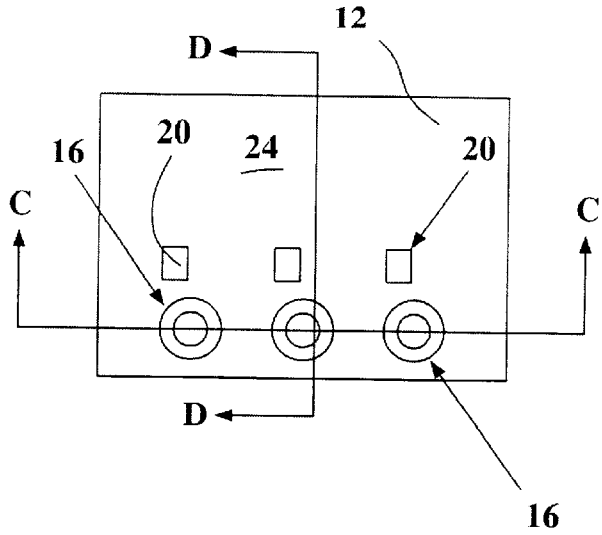
Fig. 6
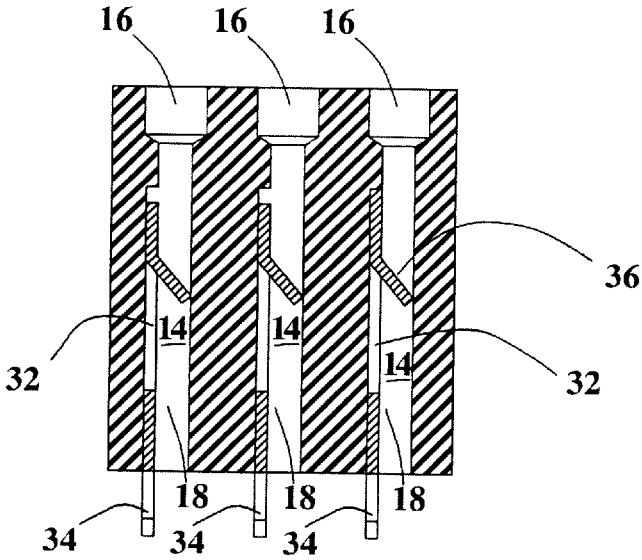
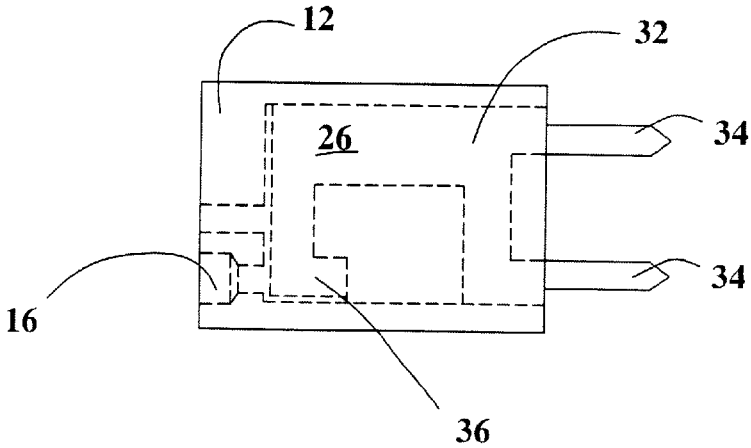
Fig. 7

HIGH ARC RESISTANT CONNECTOR HAVING A FLEXIBLE WIRE-TRAP MEMBER

BACKGROUND OF THE INVENTION

1. Field of the Invention

The present invention generally relates to electrical connectors and methods of utilizing the same. More specifically, the present invention relates to wire-trap electrical connectors having a flexible wire-trap member and a number of contact tails attached thereto.

2. Background of the Invention

Wire-trap connectors are widely used for making an electrical connection between an external electrical wire, having a stripped distal end exposing the conductor, and a wire clamping electrical contact located within the connector. In general, the stripped end of the wire is inserted within a wire insertion opening located on the outside of the wire-trap connector in order to make an electrical connection between the conductor and the clamping contact. Once the wire is inserted within the connector, the wire clamping electrical contact forms an electrical connection with the wire and prevents extraction of the wire from the connector without the use of a wire extraction tool.

To release the wire from the connector, the wire extraction tool is inserted within a wire release opening located on the outside of the connector. Once inserted, the wire extraction tool pushes against a portion of the clamping electrical contact which causes the release of the wire.

However, problems arise with commonly known and used wire-trap connectors, particularly as the size of the connector is decreased. For example, electrical arcing can occur between adjacent contact tails because the tails are spaced too close to each other when the length of the connector is reduced. In addition, a reduction in flexibility of the wire-trap member can occur as the width of the connector is reduced. The flexibility is reduced because the length of the cantilevered tab is reduced to accommodate a reduction in the width of the connector. In this regard, securing the wire within the connector can become increasingly difficult.

A need, therefore exists, to provide a wire-trap connector that includes a flexible wire-trap tab and maintains a high arc resistance as the connector is reduced in size.

SUMMARY OF THE INVENTION

The present invention provides a wire-trap connector that includes a wire-trap member adapted to apply a force in order to secure the wire within the connector. The applied force generates a torsional force within the wire-trap connector. The wire-trap member of the present invention also includes a number of contact tails attached to the wire-trap member which are spaced along the width of the connector. Any one of the contact tails is removable apart from the contact and the electrical connector. In this regard, the wire-trap connector of the present invention provides enhanced performance with respect to securing the wire and/or preventing arcing as the size of the connector is reduced.

To this end, in an embodiment of the present invention, an electrical connector is provided. The electrical connector includes a housing that has a housing width and a number of chambers that each define a first opening and a second opening wherein the first opening is adapted to receive a wire conductor. The electrical connector also includes a contact mounted within at least one of the chambers wherein the contact includes a wire-trap member and a number of contact tails attached to the wire-trap member. The tails are spaced apart along at least a portion of the housing width extending through the second opening of the chamber. The wire-trap member is adapted to apply a force for restricting movement of the wire conductor. When the electrical connector does not receive the wire conductor, a portion of the wire-trap member exists in a first plane, the contact tails exist in a second plane, and the contact exists in only the first plane and the second plane. Additionally, the first plane is not the same as the second plane.

In another embodiment, a high arc resistant connector is provided. The high arc resistant connector includes a housing that has a housing width and a number of chambers that each define a top opening wherein the top opening is adapted to receive a wire conductor. The high arc resistant connector further includes a contact mounted within at least one of the chambers. The contact includes a wire-trap member and a number of contact tails attached to the wire-trap member wherein the wire-trap member defines a C-shaped member for generating a torsional force within the contact and for apply a force to secure the wire conductor. The high arc resistant connector also includes a means for releasing the wire conductor.

In yet another embodiment, a method for securing a wire conductor within an electrical connector is provided. The method includes the steps of providing the electrical connector including a housing that has a number of chambers each defining an opening and a contact mounted within at least one of the chambers; inserting the wire conductor into the opening of at least one of the chambers; applying a force to the wire conductor directed from the contact and generating a torsional force within the contact; and restricting movement of the wire conductor.

It is, therefore, an advantage of the present invention to provide an electrical connector that includes a wire-trap member which is adapted to apply a force to restrict the movement of a wire conductor secured within the connector.

Another advantage of the present invention is to provide an electrical connector that includes a number of contact tails which are spaced along the width of the connector to prevent electrical arcing.

A further advantage of the present invention is to provide a wire-trap connector that provides enhanced performance to restrict the movement of a wire conductor and/or to prevent arcing as the size of the connector is reduced.

A still further advantage of the present invention is to provide a wire-trap connector that can be manufactured at reduced cost and that can provide enhanced performance as the size of the connector is reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 illustrates a top view of an embodiment of the wire-trap connector;

FIG. 3 illustrates a sectional view of the wire-trap connector taken along line A—A of FIG. 2;

FIG. 4 illustrates a sectional view of the wire-trap connector taken along line B—B of FIG. 2;

FIG. 5 illustrates a top view of another embodiment of the wire-trap connector of the present invention;

FIG. 6 illustrates a sectional view of the wire-trap connector taken along line C—C of FIG. 5;

FIG. 7 illustrates a sectional view of the wire-trap connector taken along line D—D of FIG. 5.

DETAILED DESCRIPTION OF THE PRESENTLY PREFERRED EMBODIMENTS

Figure 1:
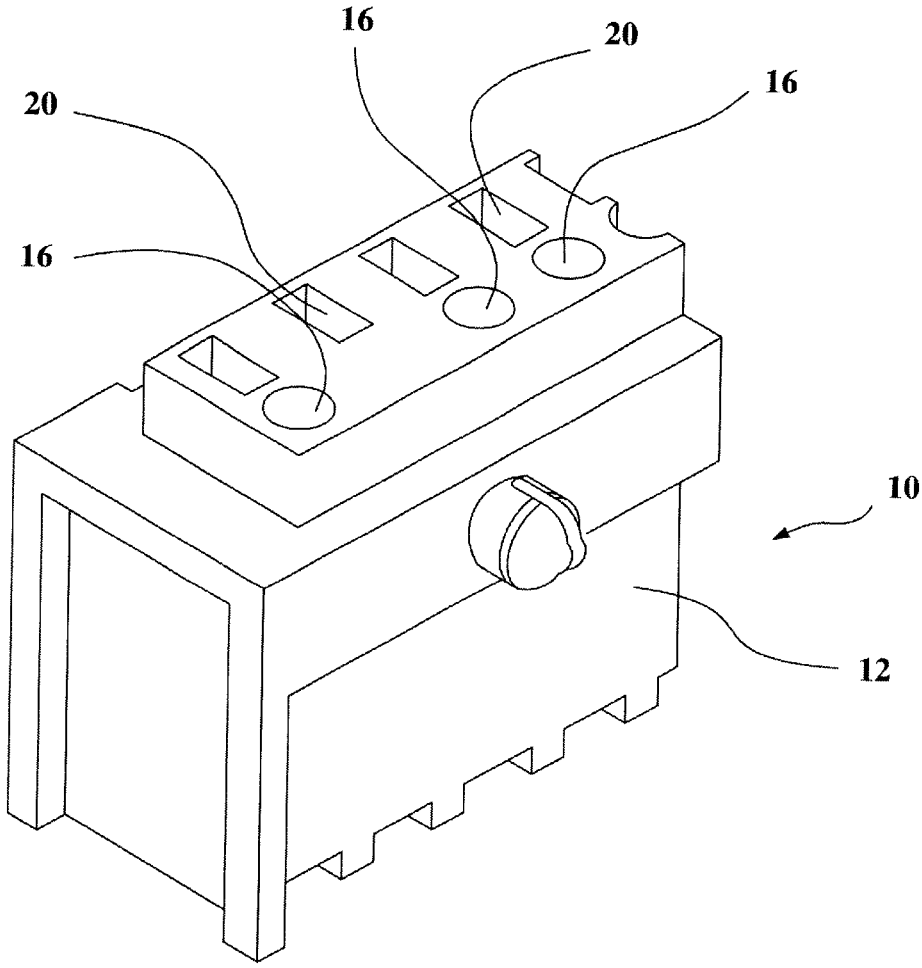
FIG. 1 illustrates a fragmentary perspective view of the wire-trap connector of the present invention.

The present invention provides an electrical connector that includes a wire-trap member which is adapted to generate a torsional force within the wire-trap member and to restrict a movement of a wire conductor inserted within the connector. The present invention further provides an electrical connector that has a number of contact tails attached to the wire-trap member wherein the contact tails are positioned along the width of the connector. In this regard, the present invention provides a wire-trap connector that utilizes the wire-trap member and/or the contact tails for enhanced performance to secure the wire conductor and to prevent arcing as the size of the connector is reduced.

As illustrated in FIGS. 1–7, the electrical connector 10 of the present invention includes a housing 12. The housing 12 can include a variety of different materials, shapes, sizes and components. For example, the housing 12 can include a make-up similar to that of the housing as disclosed in U.S. Pat. No. 5,494,456 which is hereby incorporated herein by reference.

As illustrated in FIGS. 1–7, the housing 12 has a width and a number of chambers 14 enclosed within the housing 12. The chambers 14 each define a first opening 16 and a second opening 18 wherein the first opening 16 can be adapted to receive a wire conductor (not shown).

The housing 12 can also include an additional number of openings 20 that are positioned adjacent to at least one of the first openings 16 of the housing 12. The additional openings 20 are adapted to receive a wire extraction member, such as a tool as disclosed in U.S. Pat. No. 5,494,456. Upon inserting the wire extraction member (not shown) into these openings 20, the wire extraction member can be utilized to release the wire conductor from the connector 10.

The housing openings can be located in a variety of different positions relative to one another and can include a variety of numbers. As illustrated in FIGS. 2 and 5, the housing 12 includes the same number of first openings 16 and added openings 20 adapted to receive the wire extraction member. In FIG. 2, the wire extraction openings 20 are positioned closer to an edge of a top surface 24 of the housing 12 relative to the positioning of the first openings 16. However, the present invention is not limited by this configuration. For example the wire extraction openings 20 can be placed on an opposite side of the first openings 16 as shown in FIG. 5.

As illustrated in FIGS. 3, 4, 6 and 7, a contact 26 is mounted within the chambers 14 of the housing 12. In a preferred embodiment, a contact 26 is mounted within each of the chambers 14. The contact 26 can be mounted within the housing 12 by any suitable mounting mechanism, such as by friction, by adhesion, by mechanical fasteners or other like mechanisms.

The contact 26 can be mounted directly to a wall of the chamber 14 as shown in FIG. 6. However, the present invention is not limited to this contact mounting configuration but can include any suitable configuration. For example, the contact 26 can be mounted to a wall surface that connects the first opening 16 to the chamber 14 as shown in FIG. 3.

The contact 26 includes a wire-trap member 32 and a number of contact tails 34 attached to the wire-trap member 32. The contact 26 is preferably a unitary structure stamped and formed of a metallic material, such as a phosphor bronze contact that is tin plated.

The wire-trap member 32 is adapted to apply a force to the wire conductor upon inserting the wire conductor into the chamber of the housing. The applied force generates a torque or torsional force within the wire-trap member 32. The size of the wire-trap member 32 can be reduced while still maintaining a frictional engagement with the wire conductor. In this regard, the wire conductor can be effectively secured as the size of the conductor is reduced.

Figure 8:
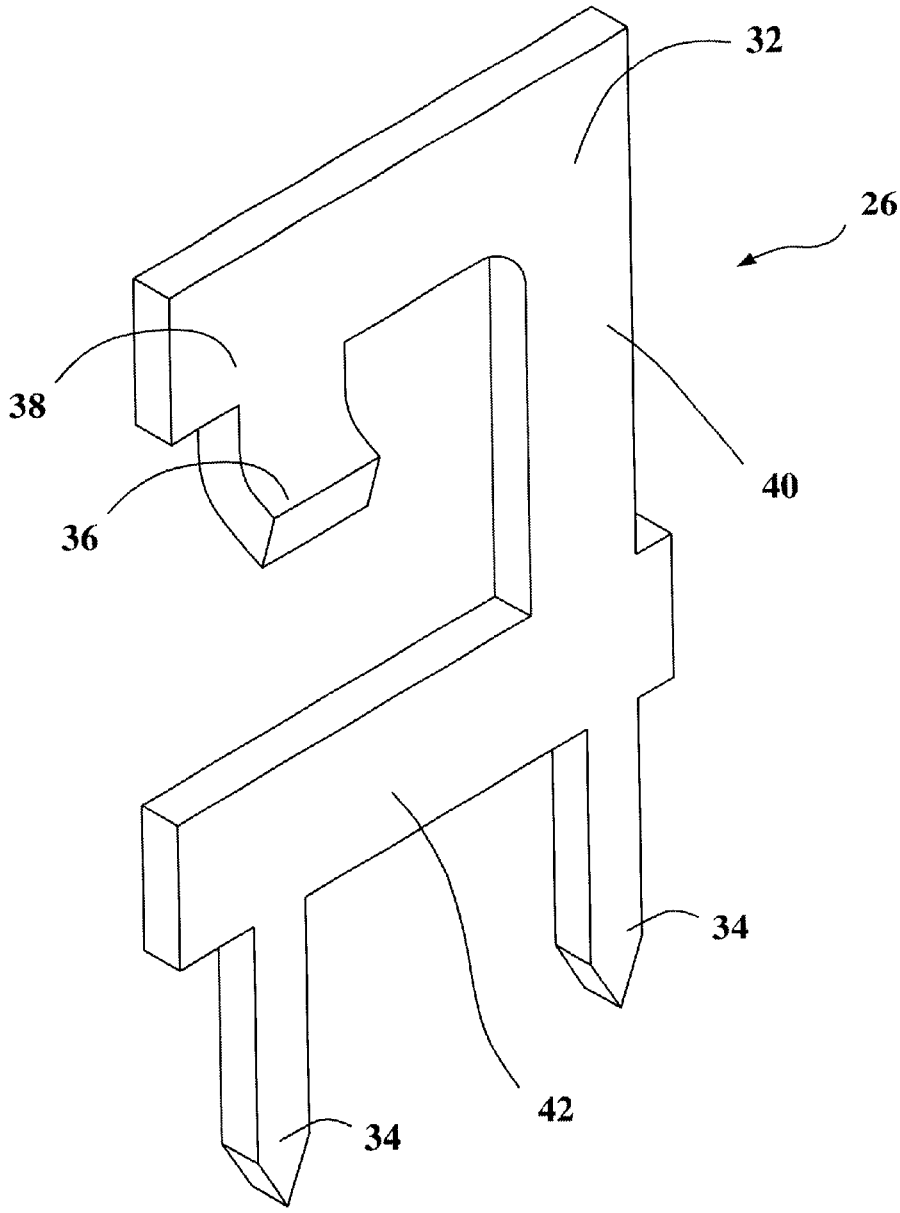
FIG. 8 illustrates a perspective view of the wire-trap member and the contract tails attached thereto of the present invention.

As illustrated in FIG. 8, the wire-trap member 32 preferably includes a C-shaped member. The C-shaped member includes a tab 36 which extends from an end 38 of the C-shaped member. The tab 36 can include a variety of different shapes and sizes and can extend from the end 38 of the wire-trap member 32 in a variety of different positions as illustrated in FIGS. 3 and 6. The C-shaped member provides flexibilty due to its circuitous design as compared to the linear, cantilevered design of the prior art.

The deflector tab 36 engages the wire conductor upon insertion of same into the housing. Upon engagement, a portion 40 of the wire-trap member acts to bend and twist in addition to bending back and forth as was done in the prior art.

It should be appreciated that the present invention is not limited by the material make-up, shape and size of the wire-trap member. The wire-trap member 32 can include any variety of make-ups, shapes and sizes such that it can effectively apply a torsional force to restrict the movement of the wire conductor. In this regard, the wire-trap member 32 maintains its flexibility and strength even as the size of the wire-trap member 32 is reduced to accommodate the reduced size of the connector 10.

As previously discussed, the contact further includes a number of contact tails 34 attached to the wire-trap member 32. The contact tails 34 are utilized to establish an electrical connection between the wire conductor and an external electronic device, such as a printed circuit board. As illustrated in FIG. 8, the contact 26 preferably includes a pair of contact tails 34 extending vertically from a surface 42 of the wire-trap member 32.

As mounted within the housing 12, the contact tails 34 preferably extend through the second opening 18 of the housing. However, it should be appreciated that the contact tails of the present invention are not limited by the number, make-up, shape and size of the contact tails. For example, the contact tails 34 can extend horizontally from the surface of the wire-trap member or extend therefrom in any other suitable position such that an electrical connection can be made.

The tails 34 are positioned along a portion of the width of the housing when mounted within the housing. This enables the connector 10 of the present invention to maintain a proper spacing between the tails 34 as the length of the connector 10 is reduced. In practice, either one of the tails 34 is removable so that an adjacent contact 26 can have the other of the two contact tails 34 removed. In this regard, an electrical connection can be established via the tails thereby effectively preventing electrical arcing between same.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that all such changes and modifications be covered by the appended claims.

What is claimed is:

1. An electrical connector comprising:

a housing having a housing width and a plurality of chambers that each define a first opening and a second opening wherein the first opening is adapted to receive a wire conductor; and a contact mounted within at least one of the plurality of chambers, the contact including a wire-trap member and a plurality of contact tails attached to the wire-trap member, the plurality of contact tails extending through the second opening of the at least one of the plurality of chambers wherein the wire-trap member applies a force to restrict movement of the wire conductor and to generate a torsional force within the contact, and wherein, when the electrical connector does not receive the wire conductor, a portion of the wire trap member exists in a first plane, the plurality of contact tails exist in a second plane, and the contact exists in only the first plane and the second plane, and wherein the first plane is not the same as the second plane.

2. The electrical connector of claim 1 wherein the plurality of contact tails includes a first contact tail and a second contact tail, and wherein the first contact tail is removable apart from the contact and the electrical connector.

3. The electrical connector of claim 1, further comprising means for releasing the wire conductor from the electrical connector.

4. The electrical connector of claim 1 wherein the wire-trap member includes a C-shaped member.

5. The electrical connector of claim 4 wherein the C-shaped member includes a deflector tab for engaging the wire conductor.

6. The electrical connector of claim 4 wherein the C-shaped member includes a portion that bends and twist for applying the torsional force.

7. The electrical connector of claim 1 wherein the contact is an integral part formed of a metallic material.

8. The electrical connector of claim 7 wherein the metallic material is a tin plated phosphorus bronze material.

9. A high arc resistant connector comprising:

a housing having a housing width and a plurality of chambers that each define a top opening wherein the top opening is adapted to receive a wire conductor;

a contact mounted within at least one of the plurality of chambers, the contact including a wire-trap member and a plurality of contact tails attached to the wire-trap member, the wire-trap member defining a C-shaped member, wherein the wire-trap member applies a force to restrict movement of the wire conductor and to generate a torsional force within the contact, and wherein, when the high arc resistant connector does not receive the wire conductor, a portion of the wire-trap member exists in a first plane, the plurality of contact tails exist in a second plane, and the contact exists in only the first plane and the second plane, and wherein the first plane is not the same as the second plane; and means for releasing the wire conductor.

10. The high arc resistant connector of claim 9 wherein the C-shaped member includes a deflector tab for engaging the wire conductor.

11. The high arc resistant connector of claim 9 wherein the C-shaped member includes a portion which twists and bends for generating a torsional force within the contact.

12. The high arc resistant connector of claim 9 wherein the plurality of contact tails are spaced apart.

13. The high arc resistant connector of claim 9 wherein the plurality of contact tails includes a first contact tail and a second contact tail, and wherein the first contact tail is removable apart from the contact and the high arc resistant connector.

14. The high arc resistant connector of claim 9 wherein the housing includes a bottom opening through which the plurality of contact tails extend.

15. The high arc resistant connector of claim 9 wherein the housing includes a first opening adjacent to the top opening of at least one of the plurality of chambers such that the first opening is adapted to receive a wire extraction member for releasing the wire conductor.

16. The high arc resistant connector of claim 9 wherein the contact is an integral part formed of a metallic material.

17. A method for securing a wire conductor within an electrical connector comprising the steps of:

providing the electrical connector including a housing having a plurality of chambers each defining an opening and a contact mounted within at least one of the plurality of chambers;

inserting the wire conductor into the opening of the at least one of the plurality of chambers;

applying a force to the wire conductor directed from the contact and generating a torsional force within the contact; and restricting movement of the wire conductor, and wherein the contact includes a C-shaped member for generating the torsional force, and wherein the C-shaped member includes a deflector tab for engaging the wire conductor, and wherein the contact includes a plurality of contact tails, and wherein, when the electrical connector does not receive the wire conductor, the deflector tab exists in a first plane, the plurality of contact tails exist in a second plane, and the contact exists in only the first plane and the second plane, and wherein the first plane is not the same as the second plane.

* * * * *